US010541480B2

(12) United States Patent
Hsu

(10) Patent No.: US 10,541,480 B2
(45) **Date of Patent: *Jan. 21, 2020**

(54) ELECTRICAL CONNECTOR ASSEMBLY

(71) Applicant: FOXCONN INTERCONNECT TECHNOLOGY LIMITED, Grand Cayman (KY)

(72) Inventor: Shuo-Hsiu Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 15/972,242

(22) Filed: May 7, 2018

(65) Prior Publication Data

US 2018/0323523 A1 Nov. 8, 2018

(30) Foreign Application Priority Data

May 5, 2017 (CN) ..... 2017 1 0311217

(51) Int. Cl.

| | |
|---|---|
| ***H01R 12/00*** | (2006.01) |
| ***H01R 12/57*** | (2011.01) |
| ***H01R 13/24*** | (2006.01) |
| ***H01R 12/71*** | (2011.01) |

(52) U.S. Cl.
CPC ..... *H01R 12/57* (2013.01); *H01R 12/714* (2013.01); *H01R 13/24* (2013.01)

(58) Field of Classification Search
CPC ..... H01R 12/57; H01R 12/714; H01R 13/24
USPC ..... 439/66, 71
See application file for complete search history.

(56) References Cited

U.S. PATENT DOCUMENTS

| | | | | |
|---|---|---|---|---|
| 9,130,322 | B2 | 9/2015 | Hsu | |
| 9,876,299 | B2 | 1/2018 | Liao et al. | |
| 2017/0201035 | A1* | 7/2017 | Liao | H01R 12/62 |

FOREIGN PATENT DOCUMENTS

| | | |
|---|---|---|
| TW | 200612523 | 4/2006 |
| TW | M533354 | 12/2016 |

* cited by examiner

*Primary Examiner* — Khiem M Nguyen
(74) *Attorney, Agent, or Firm* — Wei Te Chung; Ming Chieh Chang

(57) ABSTRACT

An electrical connector assembly provides an electrical connector mounted upon a main board, a CPU assembled upon connector with an interposer therebetween wherein some conductors on the CPU are electrically connected to the main board or to an external device via the conductive elements on the outer/exposed region of the interposer outside of the connector and a connection device, e.g., the connector set or the cable set, which is linked to those conductive elements on the outer/exposed region, while remaining conductors on the CPU are electrically connected to the main board via the conductive elements on the inner/hidden region of the interpose inside the connector by cooperation with the contacts of the connector.

20 Claims, 5 Drawing Sheets

ELECTRICAL CONNECTOR ASSEMBLY

FIELD OF THE DISCLOSURE

The invention is related to an electrical connector assembly, and particularly to the electrical connector equipped with an interposer for connecting to a CPU (Central Processing Unit).

DESCRIPTION OF RELATED ARTS

An amount of the conductors on the CPU becomes more and more in a dense manner, thus resulting in difficulties for routing the circuits on the mother board on which the corresponding electrical connector connecting the CPU and the mother board. It is especially true when different characterized conductors, e.g., for grounding, power, the low speed signal transmission or the high speed signal transmission, are mixed up within a limited region. On one hand, one feasible solution may be using a relatively complicated high-amount multilayer printed circuit boards, thus being expensive. On the other hand, such one feasible solution is still operated within a limited region without capability of categorizing different characterized conductors efficiently.

SUMMARY OF THE DISCLOSURE

The invention includes an electrical connector assembly providing an electrical connector mounted upon a main board, a CPU assembled upon connector with an interposer therebetween wherein some conductors on the CPU are electrically connected to the main board or to an external device via the conductive elements on the outer/exposed region of the interposer outside of the connector and a connection device, e.g., the connector set or the cable set, which is linked to those conductive elements on the outer/exposed region, while remaining conductors on the CPU are electrically connected to the main board via the conductive elements on the inner/hidden region of the interpose inside the connector by cooperation with the contacts of the connector. Through this arrangement, the different characteristic conductors of the CPU may be easily grouped for efficiently routing in the main board economically.

DETAILED DESCRIPTION OF THE PREFERRED EMBODIMENT

Figure 1:
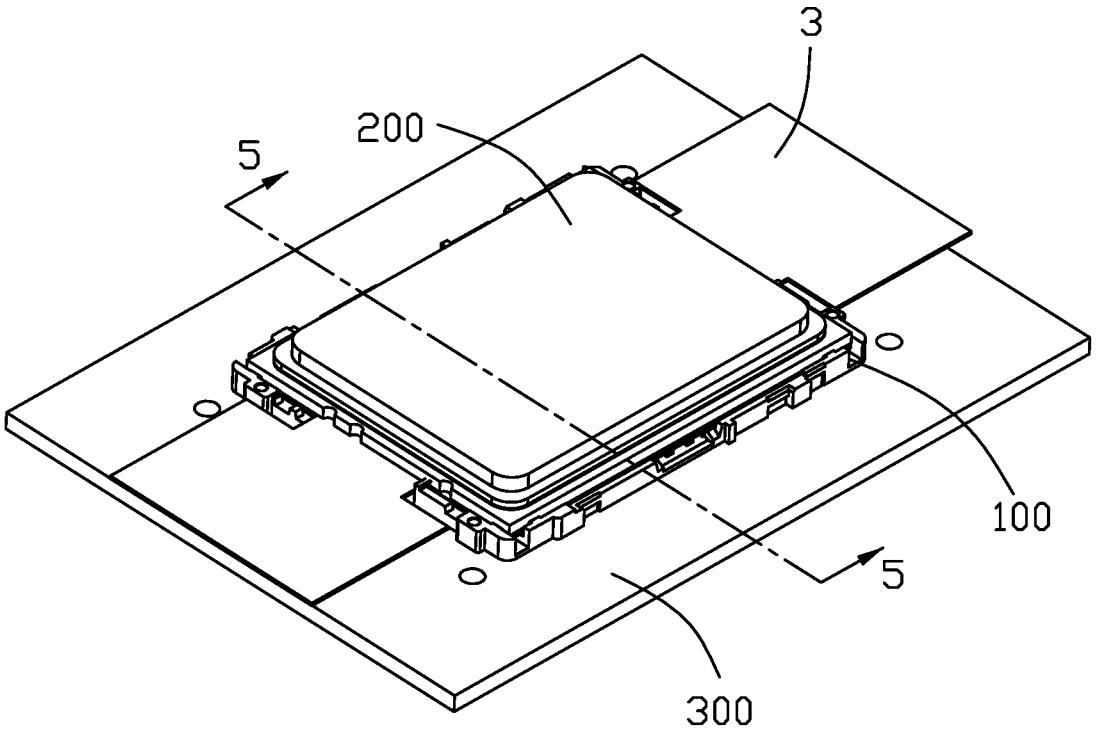
FIG. 1 is a perspective view of an electrical connector assembly according to the invention.
Figure 2:
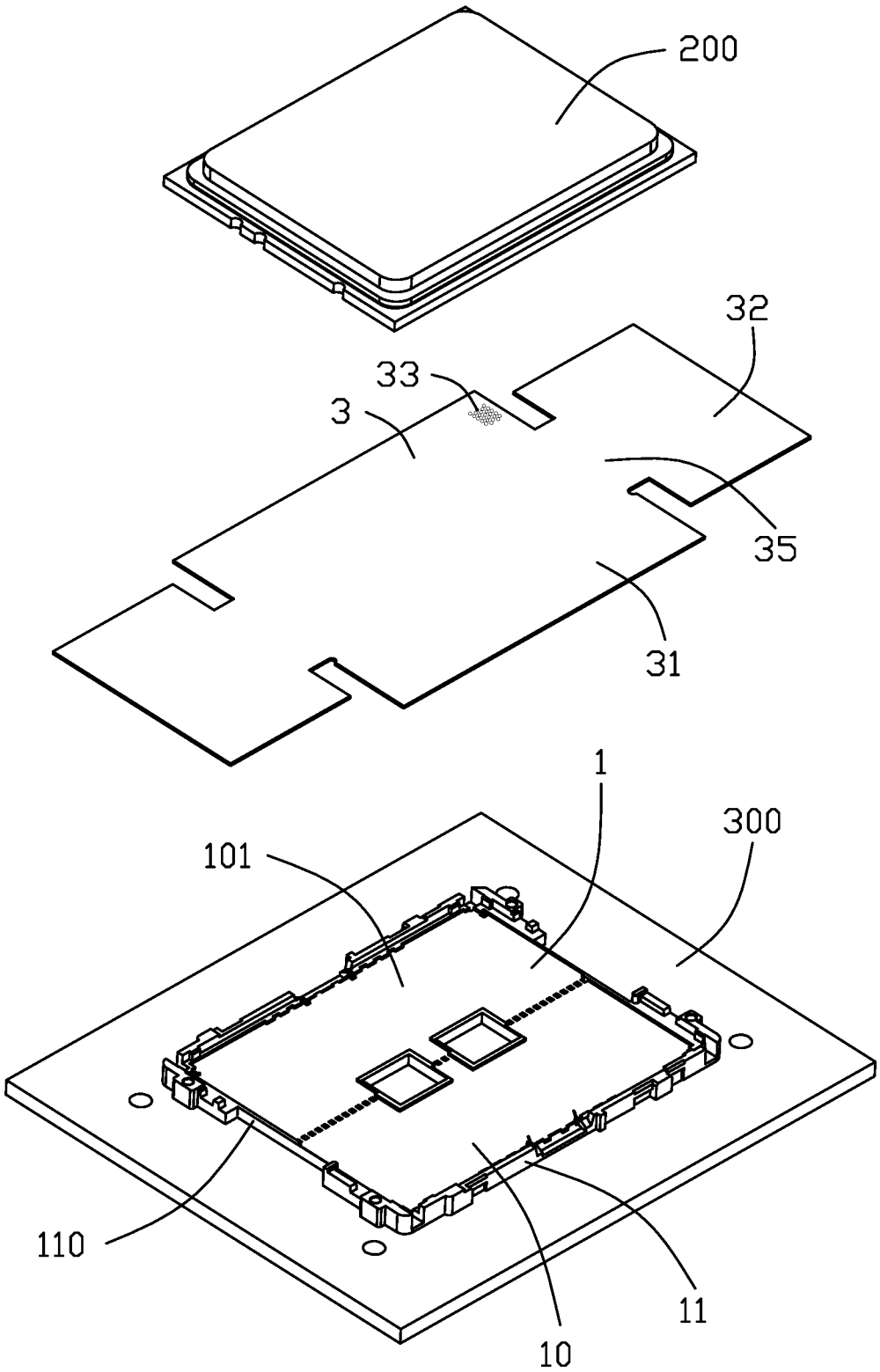
FIG. 2 is an exploded perspective view of the electrical connector assembly of FIG. 1.
Figure 3:
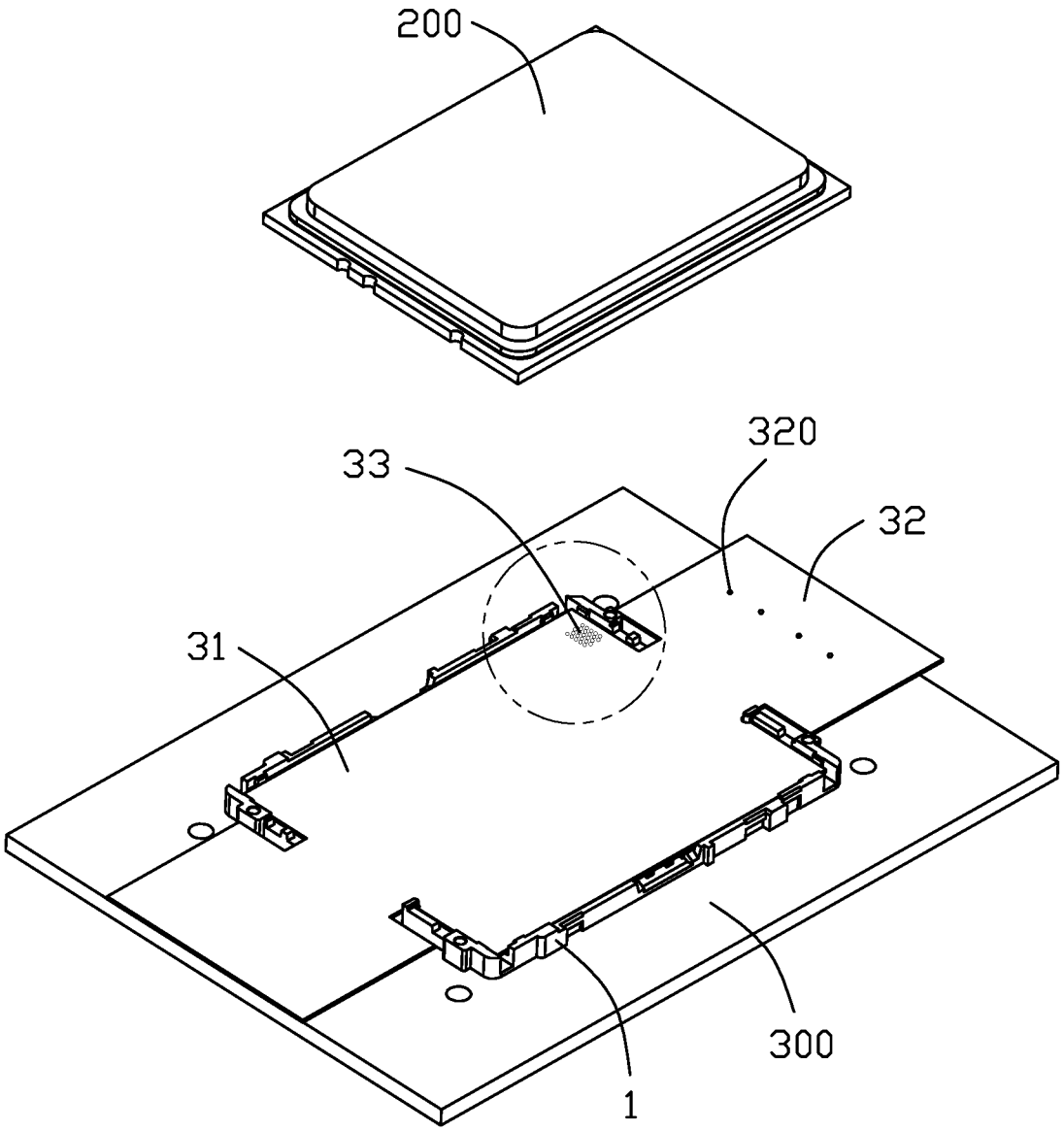
FIG. 3 is a partially assembled perspective view of the electrical connector assembly of FIG. 2 wherein the interposer is assembled into the connector.
Figure 4:
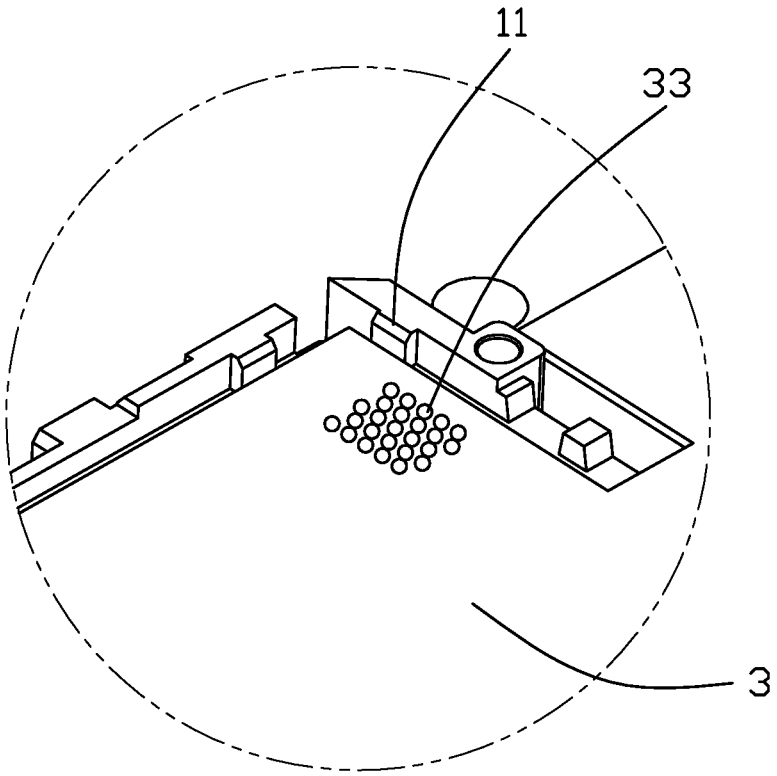
FIG. 4 is an enlarged partial perspective view of the electrical connector assembly of FIG. 3.
Figure 5:
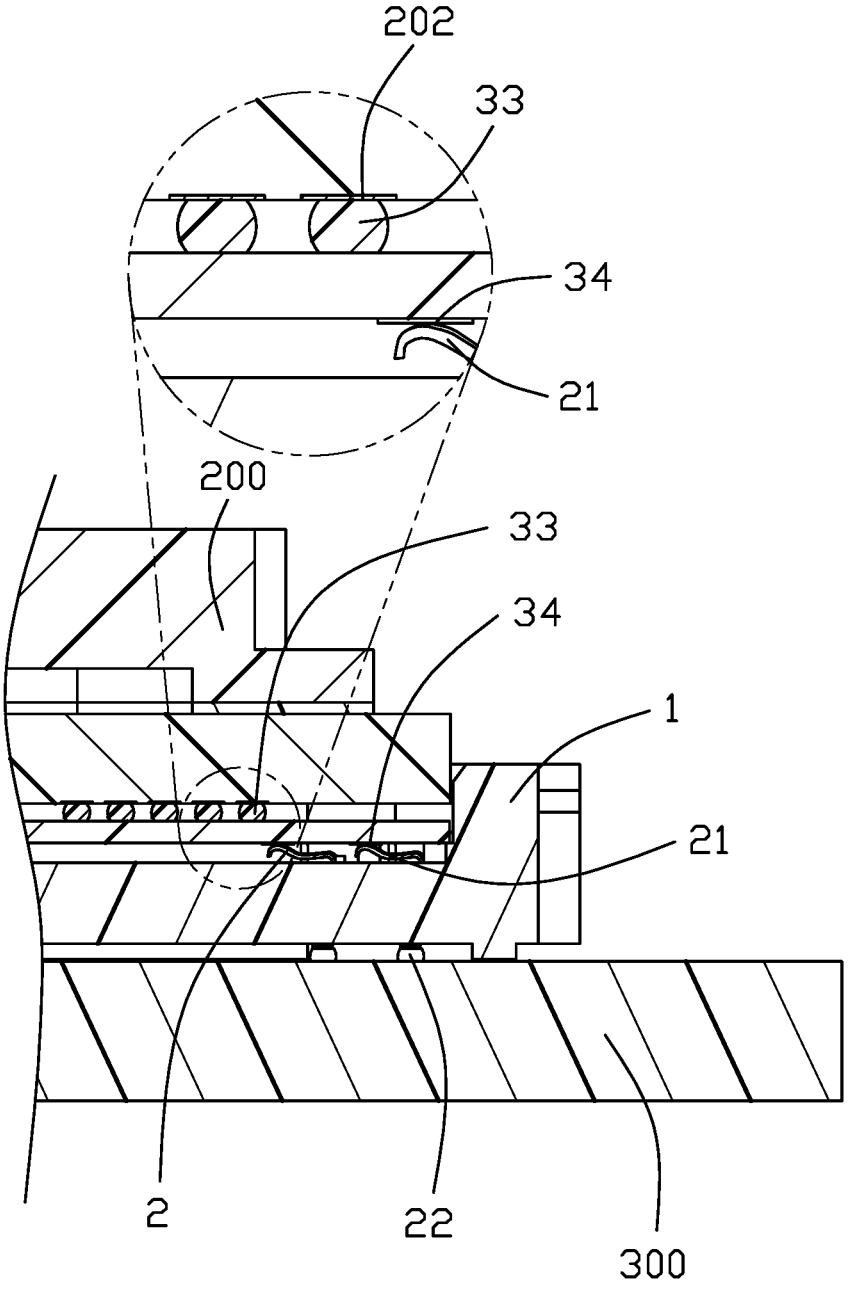
FIG. 5 is an enlarged partial cross-sectional view of the electrical connector assembly of FIG. 3.

Referring to FIGS. 1-5, an electrical connector assembly includes a main/printed circuit board 300, and an electrical connector 100 mounted upon the main board 300 to connect a CPU 200 to the main board 300. The connector 100 includes an insulative housing 1, a plurality of terminals/contacts 2 retained in the housing 1, and a plate type interposer 3 partially received within the housing 1. The housing 1 includes a base 10 and a plurality of side walls 11 extending upwardly from four sides of the base 10 so as to form a receiving cavity 101 to receive the CPU 200.

The side wall 11 of the housing 1 forms a cutout 110 for facilitating loading/unloading the CPU 200 with regard to the connector 100. The terminal 2 includes a deflectable/resilient contacting section 21 extending into the receiving cavity 101 for connecting to the interposer 3, and a connecting/soldering section (not labeled) with a solder ball 22 thereon for mounting to the main board 300.

The interposer 3 extending along a longitudinal direction, includes a main body 31 and a pair of extensions 32 by two sides of the main body 31 viewed in a transverse direction perpendicular to the longitudinal direction. The main body 31 is received within the receiving cavity 101 and forms opposite top and bottom surfaces thereof. A plurality of solder balls 33 are located upon the top surface of the main body 31 of the interposer 3 for connection with the corresponding pads 202 on the undersurface of the CPU 200. A plurality of conductive pads 34 are formed on the bottom surface of the interposer 3 to connect to the contacting sections 21 of the corresponding terminals 2, respectively. The extension 32 extends through the cutout 110 and is located beyond the housing 1 and equipped with a plurality of connection points 320. Understandably, such connection points 320 may be applied upon either top surface or the bottom surface of the extension 32 for directly or indirectly connection with the main board 300 or an external device (not shown).

Clearly, some solder balls 33 are electrically connected to the conductive pads 34 and the remaining solder balls 33 are electrically connected to the connection points 320. In other words, it is no longer necessary to have all functioning circuits commonly derived from the same limited region, i.e., the contour of the connector 110, in a dense arrangement which complicates feasibility of the circuit layout, Instead, those connection points 320 may be used to be electrically connected to an electronic component (not shown) which is relatively far from the connector 100, either intimately on or distantly above the main board 300, via a cable (not shown) extending over the main board 300. With the current arrangement, it may avoid using the expensive thicker multilayer printed circuit board for the main board 300, and avoid signal loss due to transmission via the tiny circuit paths of the printed circuit board, advantageously. In this embodiment, on one hand a neck 35 is formed between the main body 31 and the extension 32 to be received within the corresponding cutout 110 so as to prevent relative movement of the interposer 3 with regard to the housing 1 in both the longitudinal direction and the transverse direction. On the other hand, the interposer 3 is essentially sandwiched between the connector 100 and the CPU 200 in the vertical direction. In this embodiment, the extension 32 is spaced from the main board 300 with a distance in the vertical direction, and such a distance is smaller than a height of the housing 1 essentially.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a printed circuit board (PCB);

an electrical connector mounted upon the PCB and including an insulative housing with a receiving cavity, and a plurality of contacts disposed in the housing, each of said contacts including a resilient contacting section extending into the receiving cavity, and a soldering section mounted to the PCB;

a central processing unit (CPU) disposed in the receiving cavity; and an interposer having unitarily a main body received within the receiving cavity and located between the CPU and the connector in a vertical direction, and at least one extension extend from the main body outwardly away from and located outside of the connector; wherein said contacts are located under the main body.

2. The electrical connector assembly as claimed in claim 1, wherein said CPU includes a plurality of conductive pads of which, some are electrically connected to the contacts via the main body of the interposer, and remaining ones are electrically connected to corresponding connection points on the extension of the interposer.

3. The electrical connector assembly as claimed in claim 1, wherein the housing forms a cutout, and a neck is formed between the main body and the extension and received in the cutout.

4. The electrical connector assembly as claimed in claim 1, wherein a plurality of solder balls are formed on a top surface of the interposer to connect to the corresponding conductive pads of the CPU.

5. The electrical connector assembly as claimed in claim 1, wherein a plurality of solder balls are formed on a bottom side of the housing to connect the soldering sections of the contacts to the PCB.

6. The electrical connector assembly as claimed in claim 1, wherein said interposer extends in a longitudinal direction perpendicular to the vertical direction, and there are two interposers at two side of the main body viewed in a transverse direction perpendicular to both said longitudinal direction and said transverse direction.

7. The electrical connector assembly as claimed in claim 1, wherein said extension is spaced from the PCB with a distance in the vertical direction.

8. The electrical connector assembly as claimed in 7, wherein said distance is smaller than a height of the housing of the connector in the vertical direction.

9. An electrical connector assembly comprising:

a printed circuit board (PCB);

an electrical connector mounted upon the PCB in a vertical direction, and including an insulative housing with a receiving cavity therein for receiving a central processing unit (CPU), and a plurality of conductive contacts disposed in the housing, each of said contacts including a resilient contacting section extending into the receiving cavity, and a soldering section secured to the PCB; and an interposer including a main body received within the receiving cavity and adapted to be located under CPU, and at least one extension extending from the main body in a longitudinal direction and located outside of the housing; wherein the contacts are electrically and mechanically connected to the main body in the vertical direction while some connection points are formed on the extension.

10. The electrical connector assembly as claimed 9, wherein a neck is formed between the main body and the extension, and is received within a cutout in a side wall of the housing.

11. The electrical connector assembly as claimed in claim 9, wherein a plurality of solder balls are provided on a top surface of the interposer.

12. The electrical connector assembly as claimed in claim 11, wherein some of said solder balls are electrically connected to the contacting sections of the contacts under the main body of the interposer, and remaining solder balls are electrically connected to the connection points on the extension.

13. The electrical connector assembly as claimed in claim 11, wherein a plurality of solder balls are attached to soldering sections of the corresponding contacts, respectively.

14. The electrical connector assembly as claimed in claim 9, wherein said interposer is rigid so as to have the main body and the extension extend in a same horizontal plane.

15. The electrical connector assembly as claim 9, wherein there are two extensions respectively located by two sides of the main body, viewed in a transverse direction perpendicular to said longitudinal direction.

16. An electrical connector assembly comprising:

an electrical connector including an insulative housing with a receiving cavity adapted to receive a central processing unit (CPU) therein, and a plurality of contacts disposed in the housing, each of said contacts including a resilient contacting section extending into the receiving cavity, and a soldering section extending out of the housing for mounting to a printed circuit board (PCB) in a vertical direction an interposer extending in a rigid horizontal manner and including a main body received in the receiving cavity and mechanically and electrically connected to the contacting sections of the corresponding contacts, and at least one extension extending from said main body in a longitudinal direction perpendicular to said vertical direction and located outside of the housing; wherein a plurality of connection points are formed on the extension for connecting to an external component.

17. The electrical connector assembly as claimed in claim 16, wherein a first set of solder balls are formed on a top surface of the interposer for connecting to corresponding conductive pads formed on an undersurface of the CPU, and a second set of solder balls are formed on an underside of the housing and secured to the soldering sections of the corresponding contacts, respectively.

18. The electrical connector assembly as claimed in claim 16, wherein a neck is formed between the main body and the extension, and is received in a cutout formed in a corresponding side wall of the housing.

19. The electrical connector assembly as claimed in claim 16, wherein said interposer is located in a lower portion of the receiving cavity so as to allow the CPU to be received in an upper portion of the receiving cavity.

20. The electrical connector assembly as claimed in claim 16, wherein there are two extensions respectively extending from two opposite sides of the main body in the longitudinal direction.

* * * * *